US005882113A

United States Patent [19]

Binder

[11] Patent Number: 5,882,113

[45] Date of Patent: Mar. 16, 1999

[54] DEVICE FOR HOMOGENIZING AND HEATING A LIQUID OR MASHY SUBSTANCE

[75] Inventor: Maria Binder, Linz, Austria

[73] Assignee: Dep Corporation, Pembroke Pines, Fla.

[21] Appl. No.: 922,392

[22] Filed: Sep. 3, 1997

[30] Foreign Application Priority Data

Jul. 15, 1997 [DE] Germany ..... 297 12 528 U

[51] Int. Cl.[6] ..... B01F 9/10; B01F 15/06; A47J 43/27

[52] U.S. Cl. ..... 366/146; 366/197; 366/251; 366/314; 392/446

[58] Field of Search ..... 366/144, 145, 366/197, 199, 206, 241, 242, 244, 245, 247, 249, 251; 241/65, 46.11, 46.17, 101.2; 219/385, 386, 387; 99/348; 392/446

[56] References Cited

U.S. PATENT DOCUMENTS

| | | | |
|---|---|---|---|
| 2,713,110 | 7/1955 | Edgerton | 219/385 |
| 2,775,877 | 1/1957 | Bruntjen | 366/144 |
| 3,064,949 | 11/1962 | Dewenter | 366/144 |
| 4,802,407 | 2/1989 | Negri et al. | 99/348 |
| 5,363,746 | 11/1994 | Gordon | 366/146 |
| 5,720,552 | 2/1998 | Schindlegger | 366/197 |

FOREIGN PATENT DOCUMENTS

| | | | |
|---|---|---|---|
| 296 00 833 | 7/1996 | Germany | 366/197 |
| 317819 | 12/1956 | Switzerland | 366/197 |

*Primary Examiner*—Tony G. Soohoo
*Attorney, Agent, or Firm*—Jacobson, Price, Holman & Stern, PLLC

[57] ABSTRACT

There is disclosed a device for homogenizing and/or heating a liquid or mashy substance contained in a container. The container is connectable with the device. The device includes a socket element for retaining and fixing a container containing the liquid or mashy substance and a base body capable of being connected with the socket element. The base body includes a device for homogenizing the liquid or mashy substance and/or a device for heating the liquid or mashy substance.

20 Claims, 3 Drawing Sheets

DEVICE FOR HOMOGENIZING AND HEATING A LIQUID OR MASHY SUBSTANCE

The invention relates to a device for homogenizing and/or heating liquid or mashy substances, in particular liquid or mashy food or luxury food, contained in a container capable of being connected with said device.

Devices for homogenizing and/or mixing liquid or mashy substances, in particular liquid or mashy food or luxury food, are known in various configurations, wherein, for instance, simple hand mixing devices are suitable for mixing or homogenizing such materials contained in appropriate containers separate from the mixing device. Such appliances may be designed to be operated either by the mains current or by a battery. Furthermore, socalled stationary appliances are known, by which mixing and/or homogenizing of such substances is feasible, yet such stationary appliances require much space and are not apt for transportation.

Moreover, devices for heating liquid or mashy substances, in particular liquid or mashy food or luxury food, are known, which enable the heating of liquids, for instance, in the form of heating plates, immersion heaters or the like. In order to obtain the heating performance desired, such heating plates or immersion heaters usually are provided with connections to the power network, temperature control with such appliances being extremely difficult, if possible at all.

The present invention aims at providing a device of the initially defined kind, which is easy to transport and may be used for different applications, whereby even small amounts contained in accordingly small containers may be homogenized and/or controlledly heated. To solve this object, a device for homogenizing and/or heating liquid or mashy substances, in particular liquid or mashy food or luxury food, essentially is devised such that it comprises

- a socket element for retaining and fixing a container containing the liquid or mashy substance, and
- a base body capable of being connected with the socket element and including a means for homogenizing the liquid or mashy substance, in particular a motor-driven agitating mechanism, and/or a means for heating the liquid or mashy substance.

By providing, in the device according to the invention, a socket element for retaining and fixing a container containing the substance to be treated, in particular liquid or mashy food or luxury food, fixing of such a container to the device according to the invention is feasible in a simple and safe manner, such a socket element being adaptable to, for instance, pregiven dimensions or shapes of such containers in an accordingly simple manner. In addition, the invention provides for a means for homogenizing the liquid or mashy substances, and/or a means for heating the substance, in a base body capable of being connected with the socket element so as to effect homogenizing and/or heating of the substance to be treated and, in particular of the liquid or mashy food or luxury food, after retention or fixing of a container on the device according to the invention via further means directly received in the base body. Since the device according to the invention is designed for comparatively small amounts of substances to be treated, such an integrated device may be configured accordingly small and hence readily transportable and applicable on different places of use.

In order to provide for an extremely space-saving and efficient way of heating, it is proposed according to a particularly preferred embodiment that the means for heating is comprised of a resistance heating embedded in a plate-shaped element made, in particular, of synthetic material. Such a plate-shaped element made, in particular, of synthetic material may be comprised of a material suitable for, and harmless to, foodstuff in order not to exert any adverse effect on the substance to be heated even at a direct contact therewith.

According to a particularly preferred embodiment, easy and simple production is ensured in that the plate-shaped heating element is integrated in the socket element in one piece such that an insulating means and also the heating wire of the resistance heating may be directly integrated in the socket element.

In order to control the temperature in a particularly simple and efficient manner and to safely avoid overheating of the substance to be heated, a further preferred embodiment is devised such that the means for heating is coupled with at least one temperature sensor and/or a time or temperature control circuit. By providing such a time or temperature control circuit, turning off of the heating means after having reached a predetermined maximum temperature of the substance to be heated is safeguarded, thereby preventing overheating or even changing of the substance to be heated.

Since, for different purposes of use, either merely homogenizing or mixing or merely heating of the substances to be treated may partially be desired in some cases, it is additionally proposed that the means for homogenizing and the means for heating are operable independent of each other, as in accordance with a further preferred embodiment of the present invention.

As already indicated several times in the foregoing, the device according to the invention is to be suitable, in particular, for transport purposes and uses under the most different conditions, primarily on account of its small-design structure and simple design. In this connection, it is, moreover, contemplated that the means for homogenizing and the means for heating are coupled with a low-voltage source, for instance, a battery or a motor vehicle voltage supply, or with a power network source via a voltage transformer. When using a battery or a motor vehicle power supply, independence of the availability of, or accessibility to, public electricity supply networks may be ensured. In particular, when using the means for heating a liquid or mashy substance, it is to be anticipated that connection to a motor vehicle power supply or, via a voltage transformer or transformer, to a power network source is recommendable for applying the calorific input required.

In order to fix in a particularly simple manner a container containing a liquid or mashy substance to be treated, it is proposed according to a further preferred embodiment that the socket element comprises a connection member to which the container containing the liquid or mashy substance is fixable in a tight manner, wherein, according to a particularly preferred configuration, it is provided that the connection member is comprised of a threaded connection or a bayonet catch. In such a manner, containers or bottles having threaded connections, in particular standardized threaded connections, such as, e.g., feeding bottles, may, for instance, be directly fixed to the device according to the invention, or to the socket element of the same, such that an altogether closed volume will be defined by the internal volumes of the container and the base body joining the socket, in which volume homogenization and/or heating of the liquid or mashy substance contained in the container will be effected. When using a homogenizing means formed, for instance, by a motor-driven agitating mechanism, suitable rotary movement will be created within the substance contained in the container thereby causing enrichment with oxygen and sufficient blending so as to be able to prepare, for instance, baby food without clumps. For instance, when using the device according to the invention for homogenizing and/or heating the contents of feeding bottles, any desired feeding bottle may be directly and tightly fixed to the device of the invention according to the instant embodiment, such feeding bottles usually being provided with standardized threaded connections. In such an application, the temperature control provided by the invention, furthermore, is of importance with a view to safely avoid the creation of an overpressure in the interior of the container.

In addition to enabling a container containing the substance to be treated to be directly connected to the socket element, the socket element according to a modified embodiment of the device according to the invention preferably is comprised of a support intended to receive a water bath, on or in which the container containing the liquid or mashy substance may be positioned. A container containing a liquid or mashy substance to be treated may be stored in such a support intended to receive a water bath, whereby heating of the contents of the container is altogether achieved by heating the water bath by aid of the heating means integrated in the device according to the invention. By the simultaneous operation of the homogenizing means, appropriate circulation of the water bath within the support and hence equalization and enhancement of the heating performance may be achieved.

In order to provide for a particularly simple, safe and readily sealable connection between the socket element and the base body, the invention additionally contemplates in a preferred manner that the socket element is detachably fixed to the base body, in particular, by means of a screw connection or bayonet catch. By being readily detachable, the parts of the device according to the invention that get into direct contact with the substances to be treated may be removed in an accordingly simple manner and supplied to regular cleaning.

In order to facilitate mounting and dismounting of the individual parts of the device according to the invention, the invention, according to another preferred embodiment, moreover contemplates that the agitating mechanism is designed as a plastics element capable of being detached from the driven shaft of a motor.

According to a further preferred embodiment, the agitating mechanism is capable of being coupled to the driven shaft of a motor in a contactless manner, for instance, via ceramic magnets, thereby facilitating the tightness between individual parts.

With a view to providing simple energy supply to the heating means, it is proposed according to another preferred embodiment that the, particularly plate-shaped, heating means is capable of being coupled to the energy supply via sliding contacts so as to simultaneously provide, by such a configuration, safe sealing of the heating means relative to the substance to be treated. In this respect, it is, moreover, proposed in a preferred manner that the heating means is designed to include a passage for the driven shaft of the homogenizing means to pass therethrough and is mounted on the base body in a tight manner.

In the following, the invention will be explained in more detail by way of exemplary embodiments schematically illustrated in the drawing, wherein.

Figure 1:
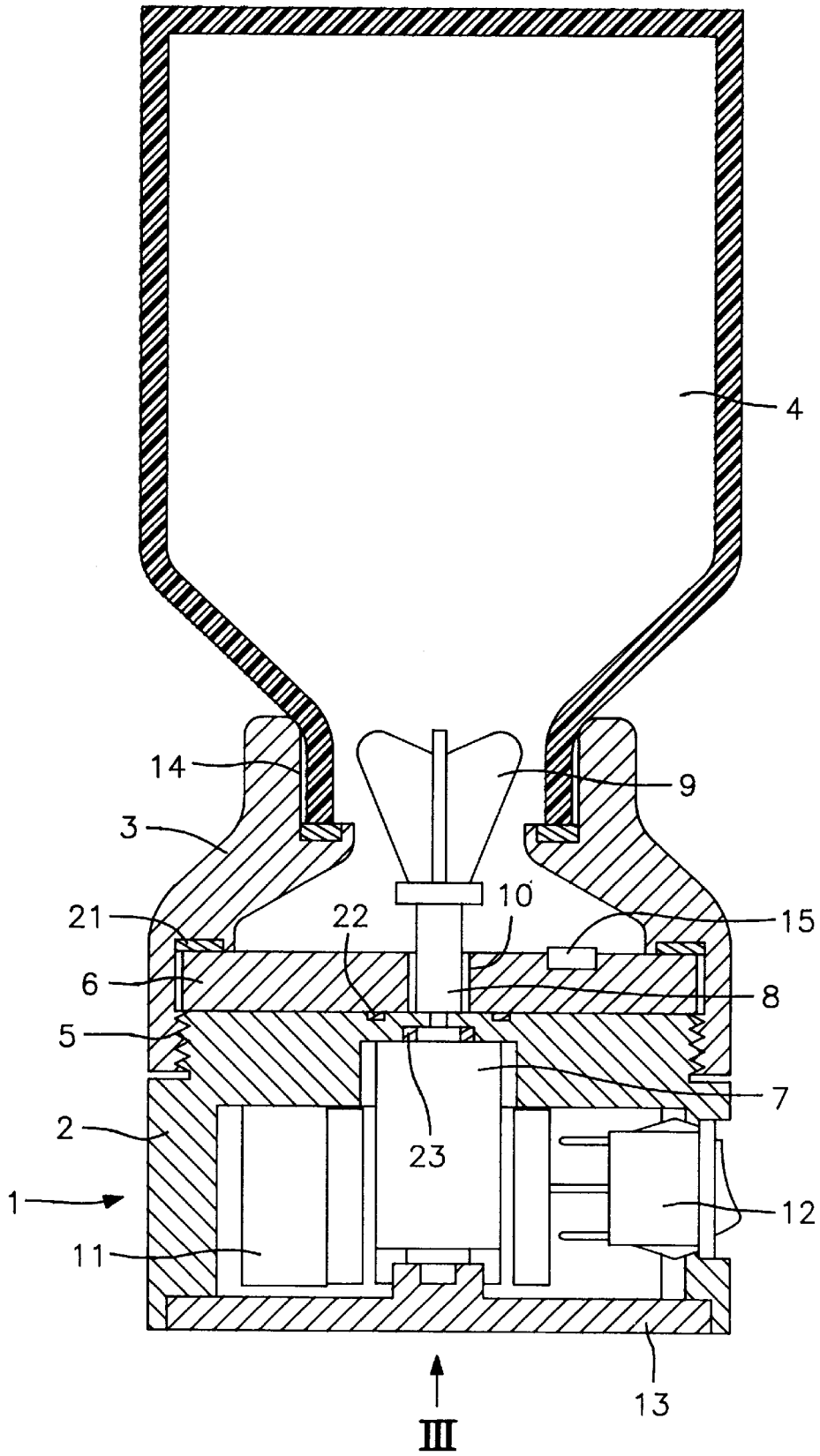
FIG. 1 is a partially sectioned side view through a first embodiment of the device according to the invention.

In the embodiment according to FIG. 1, 1 generally serves to denote a device for homogenizing and/or heating liquid or mashy substances, in particular liquid or mashy food or luxury food, such as tea, wherein a socket element 3 for retaining and fixing a container 4 is arranged on a base body 2. Fixing of the socket element 3 on the base body 2 is effected, for instance, via a schematically indicated screw connection 5, wherein, in fixing the socket element 3, a plate-shaped heating means 6 is also fixed on the base body 2, windings of a resistance heating known per se being contained in the plate-shaped heating means 6. The heating plate 6 may be made of synthetic material and at least partially comprise a plate of stainless steel on its upper side.

A motor schematically indicated by 7 is mounted in the base body 2, via the driven shaft 8 of which motor an agitating mechanism 9 is detachably fixed, the driven shaft 8 passing through a substantially concentric passage 10 of the heating plate 6. Moreover, a battery 11 as well as at least one switch 12 are arranged in the base body, as will be more clearly apparent from FIG. 3, in which the bottom plate 13 is not shown.

As is apparent from the illustration according to FIG. 1, an altogether closed volume may be established by fixing the container 4 onto the socket element 3, which comprises a connection element 14 including, for instance, a standardized threaded connection, so that a liquid or mashy substance contained in the container 4 is homogenized by means of the agitating mechanism 9 and/or simultaneous heating of the contents of the container 4 is ensured via the heating plate 6. In order to prevent the contents of the container 4 from being overheated, a temperature sensor 15 is, moreover, schematically indicated, which may be coupled with the feed line or a control for the heating plate 6 in a manner known per se. Temperature monitoring or temperature control is suitable or necessary, in particular, if, as illustrated in the exemplary embodiment depicted in FIG. 1, an altogether closed volume is established by putting on the closed container 4 such that risks involving overheating of the contents and/or breaking of the container 4 will have to be taken into account with uncontrolled heating.

Such a temperature sensor may be replaced with a timing control circuit or a bimetallic sensor, time control being feasible, for instance, in the form of an electronic timing control provided directly on the feed line to the heating means.

Figure 2:
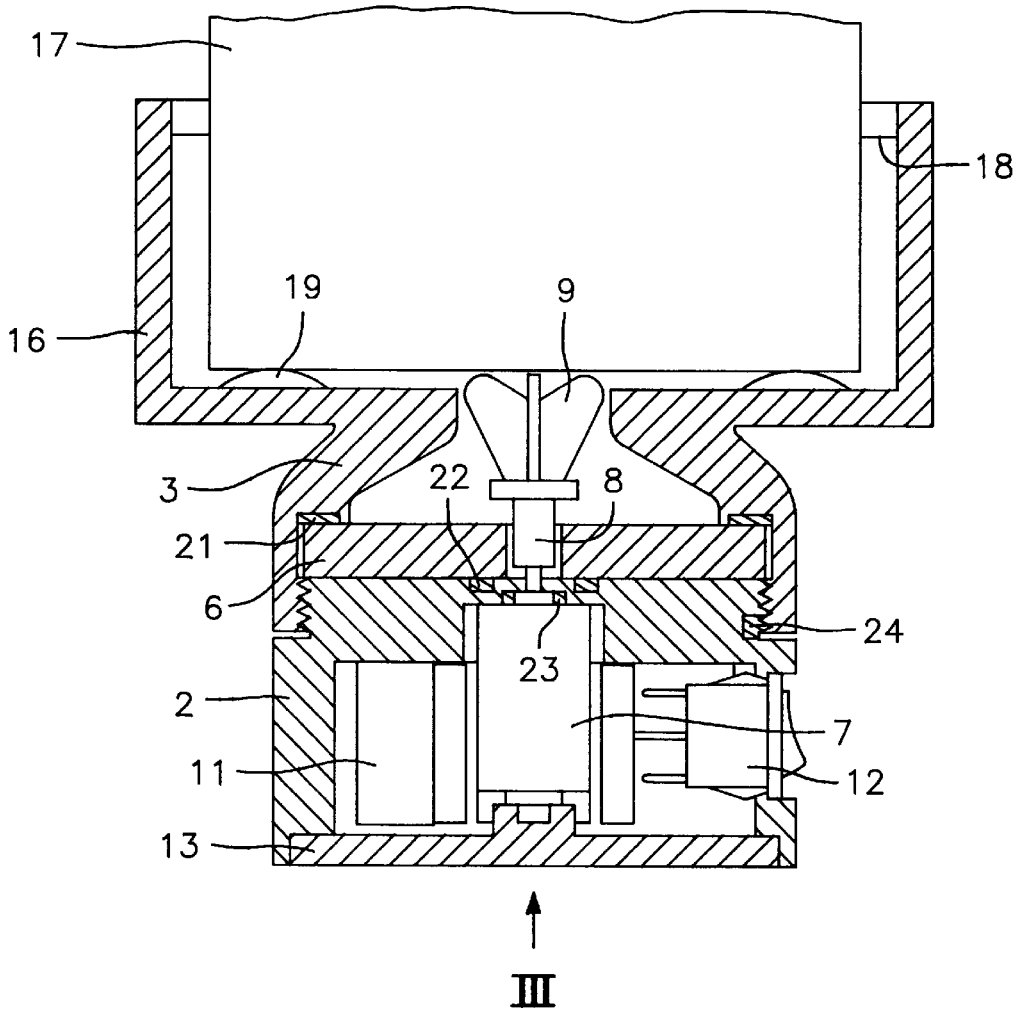
FIG. 2 is a modified embodiment of a device according to the invention in an illustration similar to FIG. 1.

In the embodiment according to FIG. 2, a modified structure to be obtained simply by exchanging individual parts is illustrated, the reference numerals of FIG. 1 having been retained for identical elements. In this embodiment, in particular, the socket element 3 is designed to include a support 16 intended to receive, for instance, a water bath, wherein, by heating the water bath by means of the heating plate 6, a container 17 placed in the support 16, or its contents, may be heated accordingly. By simultaneously actuating the agitating mechanism 9, appropriate distribution and uniform heating via the water bath, whose level is indicated by 18, may be achieved. In order to enable the distribution of the water bath, spacers 19 are indicated on the bottom of the support.

In order to seal the interior of the socket element 3 relative to the interior of the base body 2, sealing means 21, 22 and 23 are additionally indicated in FIGS. 1 and 2 in the region of the heating plate or heating means 6.

In the configuration according to FIG. 2, a switch or contact 24 is additionally indicated, which may be actuated when using the socket element 3 with the support 16, whereby limitation or interruption of the calorific input is avoided and, consequently, the water bath is heated by the heating plate 6 at full power.

Figure 3:
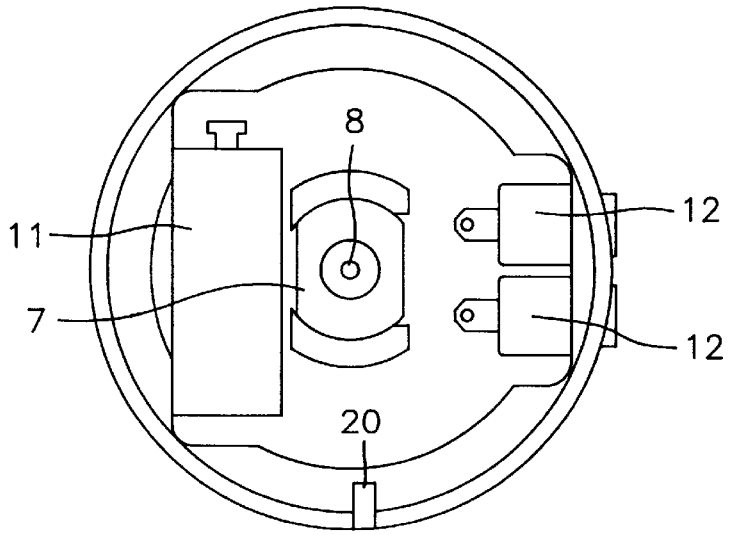
FIG. 3 is a view onto the device according to the invention in the direction of arrows III of FIGS. 1 and 2 with the bottom plate removed.

In the schematic illustration according to FIG. 3, the relative positions of the battery 11, the motor 7 with the schematically indicated driven shaft 8 as well as two switches 12 including contacts is indicated, one of the switches being provided for actuating the agitating mechanism 9, or means for homogenizing, the other switch being provided for actuating the heating means or heating plate 6. Since a relatively large energy demand must be met when effecting heating, which usually cannot be done by means of a battery 11, an additional connection sleeve 20 is indicated, which enables the device 1 to be connected, for instance, to the power supply of a motor vehicle, such as a cigarette lighter, or to a power network source via a voltage transformer.

Figure 4:
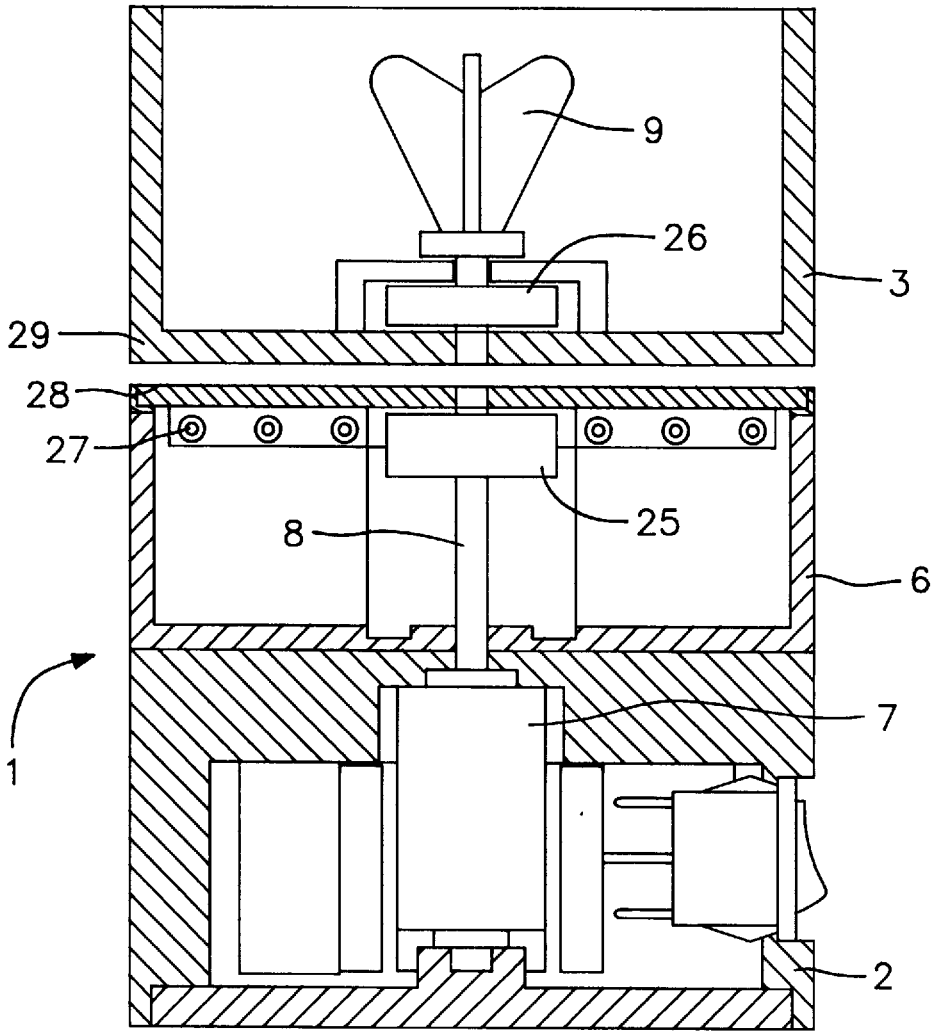
FIG. 4 depicts a further modified embodiment of a device according to the invention, again in an illustration similar to FIG. 1.

In the embodiment illustrated in FIG. 4, the reference numerals of the preceding Figures have been retained for identical structural components. Thus, a schematically indicated motor 7 is again mounted in the base body 2, the motor 7 or its driven shaft 8 in this embodiment being coupled with magnets 25, such as, for instance, ceramic magnets. In this embodiment, contactless simultaneous movement of the agitating mechanism 9 is effected via further magnets 26, in particular ceramic magnets, mounted in the socket element 3 such that, on the whole, the sealing problem between the base body 2 and the socket element 3 may be avoided or strongly reduced, since the socket element 3 may be designed in a substantially tight manner and merely is placed on the base body. Heating of the liquid contained in the socket element 3 by means of the heating plate 6 directly integrated in the base body 2, the resistance wires of which are indicated at 27, is effected merely in that the cover surfaces of both the heating plate 6 and the socket part 3 to be put on, which cover surfaces are schematically indicated by 28 and 29, respectively, are each comprised of a metallic and, in particular, thermally well conducting material. After having put the socket element 3 on the base body 2, heating of the liquid contained in the socket element 3 may, therefore, be effected by switching on the heating plate 6, i.e., heating either of a liquid or mashy food or, in a manner similar to the embodiment of FIG. 2, of a water bath, optionally during simultaneous actuation of the agitating mechanims.

By the device 1, liquid or mashy substances already contained in containers may, thus, be homogenized and/or heated, and hence prepared for consumption, by means of a readily handleable and operationally safe structure, optionally independent of public supply networks.

What I claim is:

1. A device for homogenizing and heating a liquid or mashy substance contained in a container capable of being connected with said device, said device comprising:

a socket element constructed to retain and fix said container containing said liquid or mashy substance, a base body capable of being connected with said socket element, homogenizing means located in said base body for homogenizing said liquid or mashy substance, heating means located in said base body for heating said liquid or mashy substance, said heating means including a resistance heating means embedded in a plate-shaped element so as to form a plate-shaped heating means, and a low-voltage source for said homogenizing means and said plate-shaped heating means to be coupled therewith.

2. A device as set forth in claim 1, wherein said homogenizing means for homogenizing said liquid or mashy substance is comprised of a motor-driven agitating mechanism.

3. A device as set forth in claim 2, further comprising a motor driving said agitating mechanism and including a driven shaft, and wherein said motor-driven agitating mechanism is comprised of a synthetic element capable of being attached to and detached from said driven shaft of said motor.

4. A device as set forth in claim 1, wherein said plate-shaped element is made of synthetic material.

5. A device as set forth in claim 1, wherein said plate-shaped heating means is integrated in said socket element in one piece.

6. A device as set forth in claim 1, further comprising at least one of at least one temperature sensor and a control circuit coupled with said heating means.

7. A device as set forth in claim 6, wherein said control circuit is a time control circuit.

8. A device as set forth in claim 6, wherein said control circuit is a temperature control circuit.

9. A device as set forth in claim 1, wherein said homogenizing means and said heating means are operable independent of each other.

10. A device as set forth in claim 1, wherein said low-voltage source is comprised of a battery.

11. A device as set forth in claim 1, wherein said low-voltage source is comprised of a motor vehicle power supply.

12. A device as set forth in claim 1, further comprising a connection means provided in said socket element and adapted to ensure said container containing said liquid or mashy substance to be fixed thereon in a tight manner.

13. A device as set forth in claim 12, wherein said connection means is comprised of a threaded connection means.

14. A device as set forth in claim 12, wherein said connection means is comprised of a bayonet catch.

15. A device as set forth in claim 1, wherein said socket element is detachably fixed to said base body.

16. A device as set forth in claim 15, further comprising a screw connection means adapted to detachably fix said socket element to said base body.

17. A device as set forth in claim 15, further comprising a bayonet catch means adapted to detachably fix said socket element to said base body.

18. A device as set forth in claim 1, further comprising sliding contacts capable of coupling said heating means to energy supply source means.

19. A device as set forth in claim 1, further comprising sliding contacts capable of coupling said plate-shaped heating means to energy supply source means.

20. A device as set forth in claim 1, wherein said homogenizing means comprises a driven shaft and wherein said heating means includes a passage for said driven shaft of said homogenizing means to pass therethrough and is mounted on said base body in a tight manner.

* * * * *